US011626047B1

(12) United States Patent
Cai et al.

(10) Patent No.: US 11,626,047 B1
(45) Date of Patent: Apr. 11, 2023

(54) REFERENCE ARRAY CURRENT SENSING

(71) Applicant: Apple Inc., Cupertino, CA (US)

(72) Inventors: Shengchang Cai, Sunnyvale, CA (US); Hasan Akyol, Mountain View, CA (US); Xuebei Yang, Fremont, CA (US); Sheng Zhang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/405,497

(22) Filed: Aug. 18, 2021

Related U.S. Application Data

(60) Provisional application No. 63/083,676, filed on Sep. 25, 2020.

(51) Int. Cl.
*G09G 3/32* (2016.01)
*G09G 3/00* (2006.01)

(52) U.S. Cl.
CPC ..... *G09G 3/006* (2013.01); *G09G 2320/045* (2013.01); *G09G 2320/0693* (2013.01); *G09G 2330/12* (2013.01); *G09G 2360/16* (2013.01)

(58) Field of Classification Search
CPC ..... G09G 3/006; G09G 2320/045; G09G 2320/0693; G09G 2330/12; G09G 2360/16
See application file for complete search history.

(56) References Cited

U.S. PATENT DOCUMENTS 10,818,217 B1 * 10/2020 Hsiang ..... G09G 3/2007
2008/0068309 A1 * 3/2008 Kwak ..... H01L 27/3276 345/82
2010/0177126 A1 * 7/2010 Inoue ..... G09G 3/007 345/690
2014/0300618 A1 * 10/2014 Wyatt ..... G06T 5/40 345/589
2016/0148564 A1 * 5/2016 Kim ..... G09G 3/3233 345/82
2017/0269398 A1 * 9/2017 Park ..... H01L 27/1244
2018/0061913 A1 * 3/2018 Kim ..... G09G 3/3225
2018/0075798 A1 * 3/2018 Nho ..... G09G 3/32
2018/0090109 A1 * 3/2018 Lin ..... G09G 5/393
2018/0144683 A1 * 5/2018 Shin ..... G09G 3/3225
2019/0057633 A1 * 2/2019 Li ..... G09G 3/3258
2019/0088199 A1 * 3/2019 Zhang ..... G09G 3/3233
2019/0088205 A1 * 3/2019 Zhang ..... G09G 3/3233
2020/0349894 A1 * 11/2020 Ko ..... G09G 3/006

* cited by examiner

*Primary Examiner* — Jose R Soto Lopez
(74) *Attorney, Agent, or Firm* — Fletcher Yoder, P.C.

(57) ABSTRACT

Embodiments disclosed herein provide systems and methods for testing and compensating for pixel degradation in an electronic display based on current and voltage values sensed in a reference array. An electronic display includes an active array, a reference array, and sensing circuitry. A compensation manager obtains current data values of the reference array from the sensing circuitry. The compensation manager generates a current-voltage curve based on the current data and adjusts the current-voltage curve to compensate for variations in temperature and/or pixel brightness. In this way, the compensation manager may improve performance of the electronic display by, for example, by reducing visible anomalies.

20 Claims, 8 Drawing Sheets

REFERENCE ARRAY CURRENT SENSING

CROSS-REFERENCE TO RELATED APPLICATIONS

This application claims the benefit of U.S. Provisional Application No. 63/083,676, filed Sep. 25, 2020, and entitled "REFERENCE ARRAY CURRENT SENSING," which is incorporated herein by reference in its entirety for all purposes.

SUMMARY

The present disclosure generally relates to electronic displays and, more particularly, to testing and compensating for pixel degradation in an electronic display based on current and voltage values sensed in a reference array.

Flat panel displays, such as light-emitting diode (LED) displays or organic-LED (OLED) displays, are commonly used in a wide variety of electronic devices, including such consumer electronics such as televisions, computers, and handheld devices (e.g., cellular telephones, audio and video players, gaming systems, and so forth). Such display panels typically provide a flat display in a relatively thin package that is suitable for use in a variety of electronic goods. In addition, such devices may use less power than comparable display technologies, making them suitable for use in battery-powered devices or in other contexts where it is desirable to minimize power usage.

Electronic displays typically include pixels arranged in a matrix to display an image that may be viewed by a user. Individual pixels of an LED display may generate light as current is applied to each pixel. Current may be applied to each pixel by programming a voltage to the pixel that is converted by circuitry of the pixel into the current. The circuitry of the pixel that converts the voltage into the current may include, for example, thin film transistors (TFTs). However, certain operating conditions, such as aging or temperature, may affect the amount of current applied to a pixel in relation to the programmed voltage.

Display panel sensing allows for operational properties of pixels of an electronic display to be identified to improve the performance of the electronic display. For example, variations in temperature and periphery circuit aging (e.g., an LDO) (among other things) across the electronic display cause pixels on the display to behave differently. Indeed, the same image data programmed on different pixels of the display could appear to be different due to the variations in temperature and periphery circuit aging. For example, a pixel emits an amount of light, gamma, or grey level based at least in part on an amount of current supplied to a diode (e.g., an LED) of the pixel. For voltage-driven pixels, a target voltage may be applied to the pixel to cause a target current to be applied to the diode (e.g., as expressed by a current-voltage relationship or curve) to emit a target gamma value. Variations may affect a pixel by, for example, changing the resulting current that is applied to the diode when applying the target voltage. Without appropriate compensation, these variations could produce undesirable visual artifacts.

Accordingly, the techniques and systems described below may be used to test and compensate for the functionality of various components of the display. A compensation manager may compensate for degradation of one or more pixels in the display based on current and voltage values sensed from a reference array that is used for the testing. The compensation manager may determine a current through circuitry of each pixel of the display to confirm operation of each pixel and corresponding components.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings described below.

DETAILED DESCRIPTION OF SPECIFIC EMBODIMENTS

Figure 1:
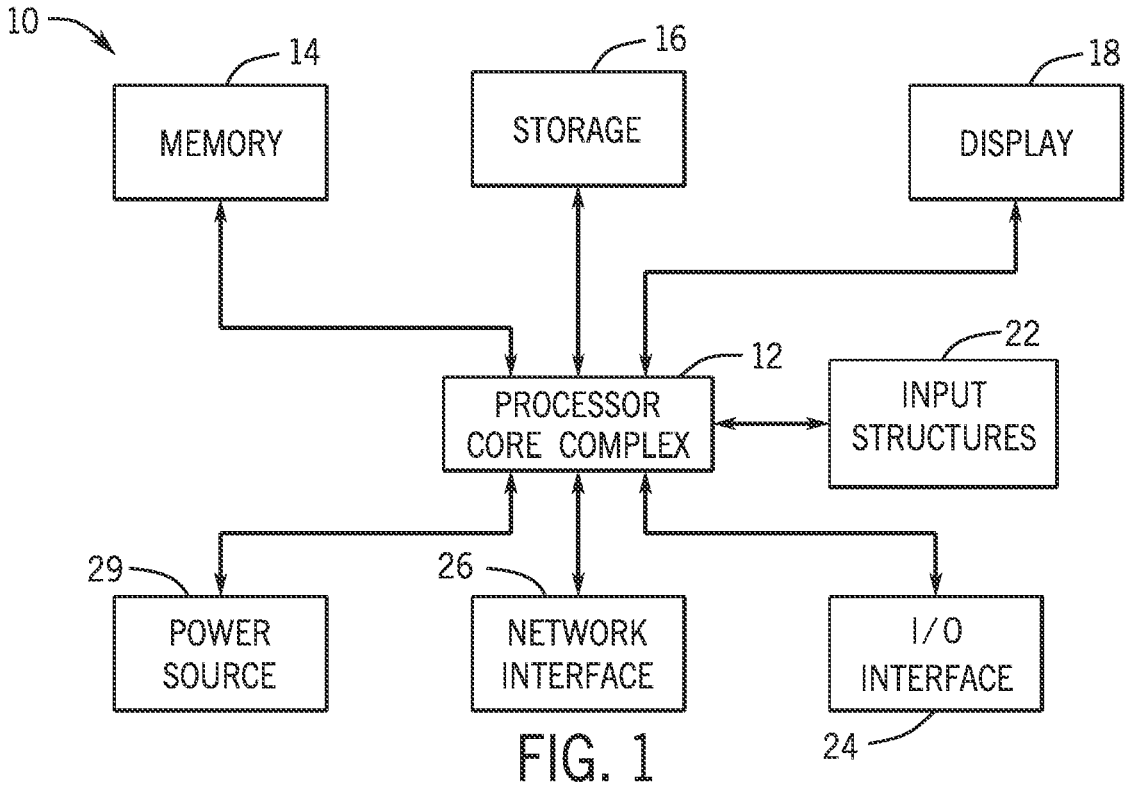
FIG. 1 is a block diagram of an electronic device, according to an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Electronic displays are ubiquitous in modern electronic devices. As electronic displays gain ever-higher resolutions and dynamic range capabilities, image quality has increasingly grown in value. In general, electronic displays contain numerous picture elements, or "pixels," that are programmed with image data. Each pixel emits a particular amount of light based at least in part on the image data. By programming different pixels with different image data, graphical content including images, videos, and text can be displayed.

Display panel sensing allows for operational properties of pixels of an electronic display to be identified to improve the performance of the electronic display. For example, variations in temperature and periphery circuit (e.g., an LDO) aging (among other things) across the electronic display cause pixels on the display to behave differently from calibration. Indeed, the same calibrated image data could appear to be different due to the variations in temperature and periphery circuit aging. For example, a pixel emits an amount of light, gamma, or grey level based at least in part on an amount of current supplied to a diode (e.g., an LED) of the pixel. For voltage-driven pixels, a target voltage may be applied to the pixel to cause a target current to be applied to the diode (e.g., as expressed by a current-voltage relationship or curve) to emit a target gamma value. Variations may affect a pixel by, for example, changing the resulting current that is applied to the diode when applying the target voltage. Without appropriate compensation, these variations could produce undesirable visual artifacts.

Accordingly, the techniques and systems described below may be used to test and compensate for functionality of various components of the display. Testing circuitry is coupled to an active array and a reference array of the display. The testing circuitry may determine current and/or voltage for driving pixels of the active array based at least in part on current and/or voltage data sensed from the reference array. The testing circuitry may determine a current through circuitry of each pixel of the reference array and compensate for variations of the display, such as temperature and periphery circuit aging.

Figure 2:
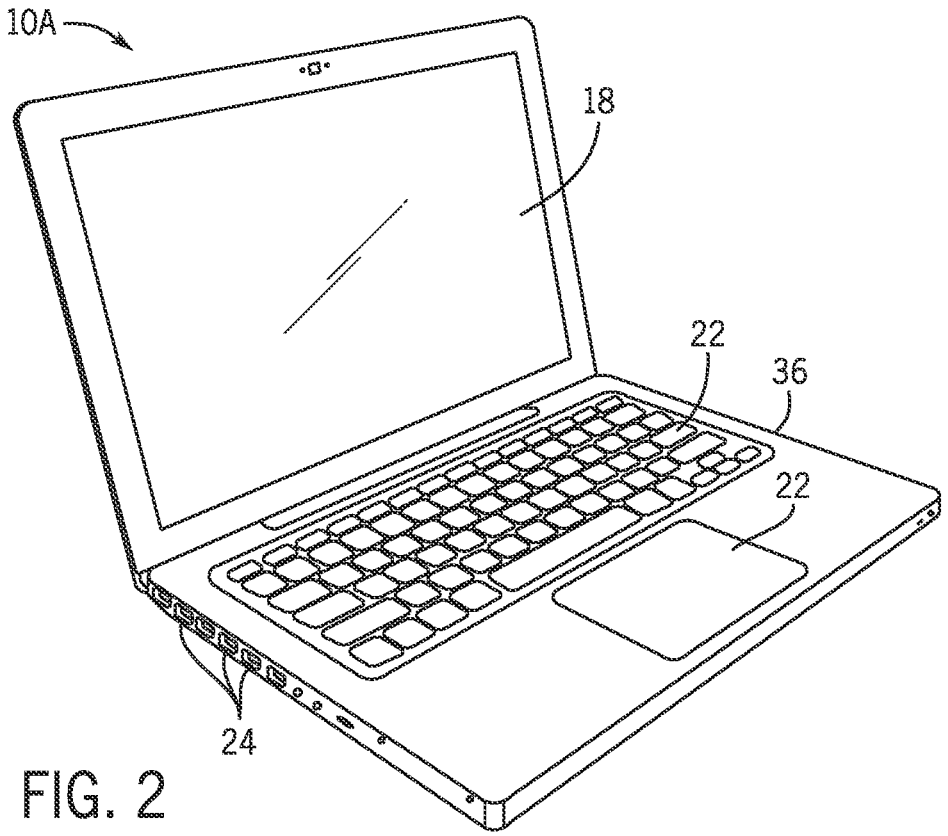
FIG. 2 is a perspective view of a notebook computer representing an embodiment of the electronic device of FIG. 1.
Figure 4:
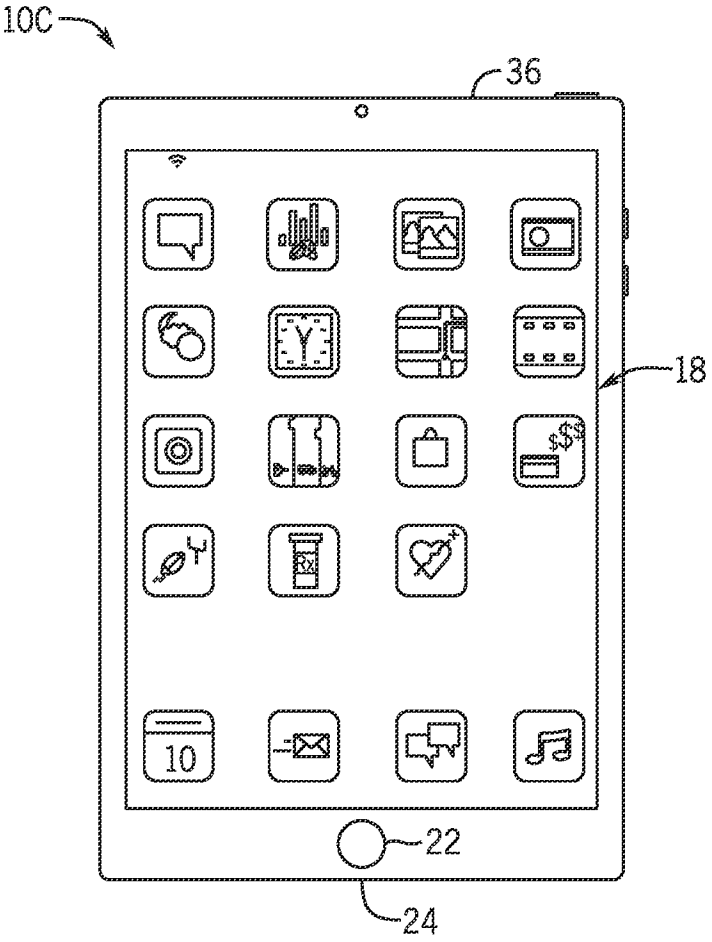
FIG. 4 is a front view of another handheld device representing another embodiment of the electronic device of FIG. 1.
Figure 3:
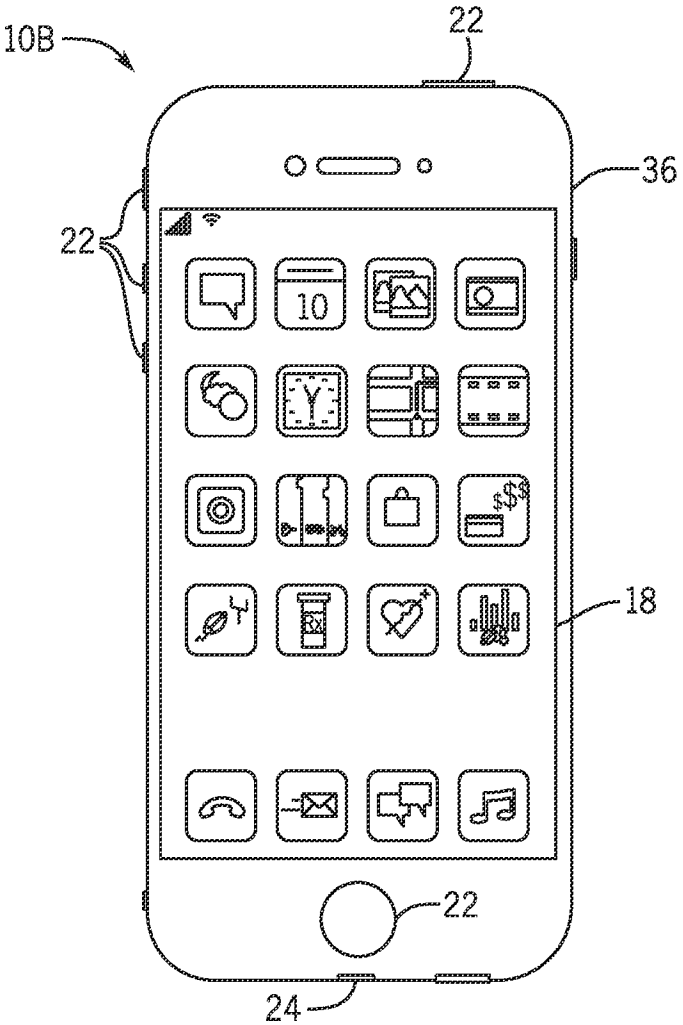
FIG. 3 is a front view of a handheld device representing another embodiment of the electronic device of FIG. 1.
Figure 5:
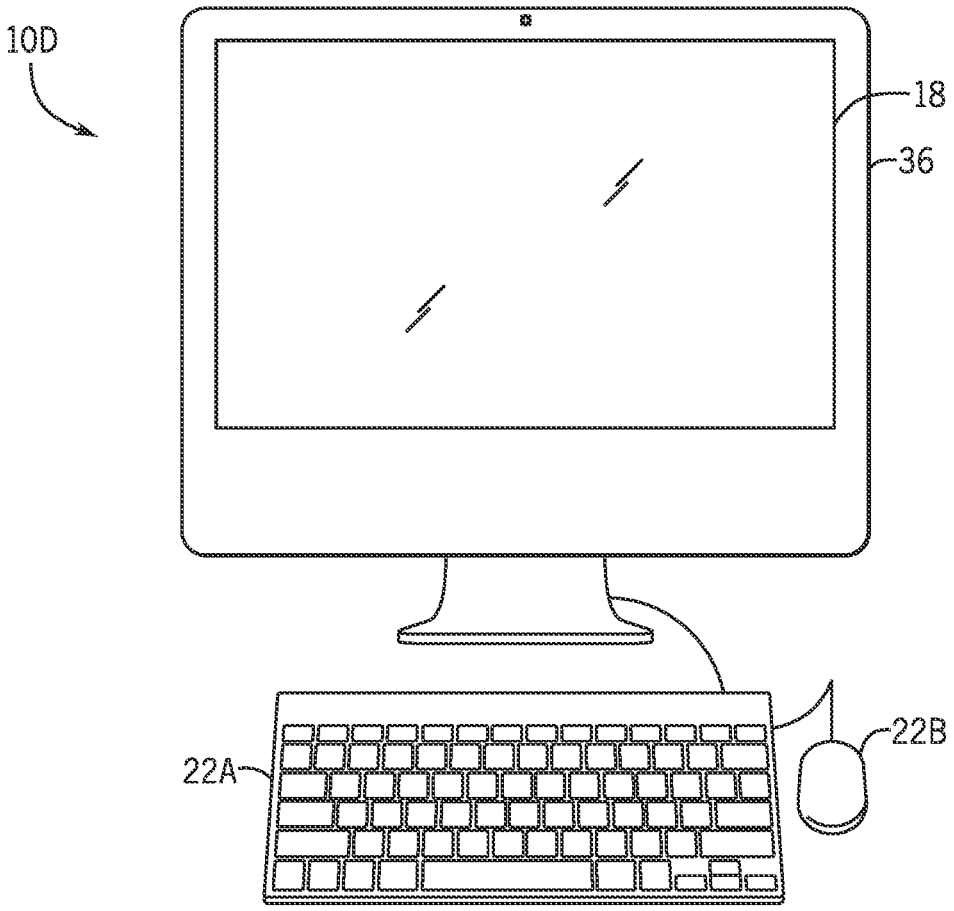
FIG. 5 is a front view of a desktop computer representing another embodiment of the electronic device of FIG. 1.
Figure 6:
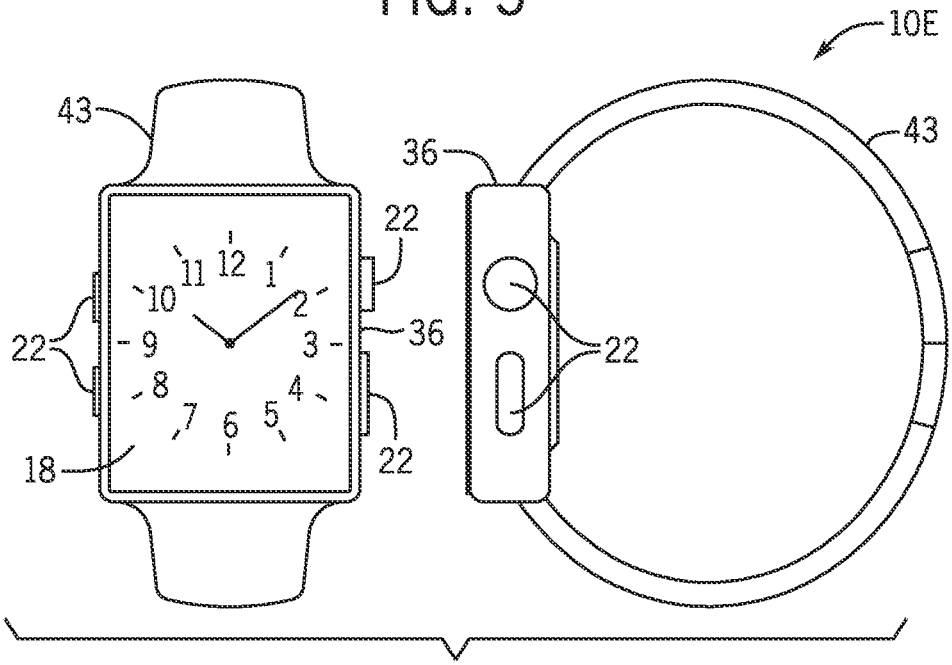
FIG. 6 is a perspective view of a wearable electronic device representing another embodiment of the electronic device of FIG. 1.

With this in mind, a block diagram of an electronic device 10 is shown in FIG. 1. As will be described in more detail below, the electronic device 10 may represent any suitable electronic device, such as a computer, a mobile phone, a portable media device, a tablet, a television, a virtual-reality headset, a vehicle dashboard, or the like. The electronic device 10 may represent, for example, a notebook computer 10A as depicted in FIG. 2, a handheld device 10B as depicted in FIG. 3, a handheld device 10C as depicted in FIG. 4, a desktop computer 10D as depicted in FIG. 5, a wearable electronic device 10E as depicted in FIG. 6, or a similar device.

The electronic device 10 shown in FIG. 1 may include, for example, a processor core complex 12, a local memory 14, a main memory storage device 16, an electronic display 18, input structures 22, an input/output (I/O) interface 24, network interfaces 26, and a power source 29. The various functional blocks shown in FIG. 1 may include hardware elements (including circuitry), software elements (including machine-executable instructions stored on a tangible, non-transitory medium, such as the local memory 14 or the main memory storage device 16) or a combination of both hardware and software elements. It should be noted that FIG. 1 is merely one example of a particular implementation and is intended to illustrate the types of components that may be present in electronic device 10. Indeed, the various depicted components may be combined into fewer components or separated into additional components. For example, the local memory 14 and the main memory storage device 16 may be included in a single component.

The processor core complex 12 may carry out a variety of operations of the electronic device 10, such as causing the electronic display 18 to perform display panel sensing and generate a current-voltage (IV) curve that may be used to adjust image data to be displayed on the electronic display 18. The processor core complex 12 may include any suitable data processing circuitry to perform these operations, such as one or more microprocessors, one or more application specific processors (ASICs), or one or more programmable logic devices (PLDs). In some cases, the processor core complex 12 may execute programs or instructions (e.g., an operating system or application program) stored on a suitable article of manufacture, such as the local memory 14 and/or the main memory storage device 16. In addition to instructions for the processor core complex 12, the local memory 14 and/or the main memory storage device 16 may also store data to be processed by the processor core complex 12. By way of example, the local memory 14 may include random access memory (RAM) and the main memory storage device 16 may include read only memory (ROM), rewritable non-volatile memory such as flash memory, hard drives, optical discs, or the like.

The electronic display 18 may display image frames, such as a graphical user interface (GUI) for an operating system or an application interface, still images, or video content. The processor core complex 12 may supply at least some of the image frames. The electronic display 18 may be a self-emissive display, such as an organic light emitting diodes (OLED) display, a micro-LED display, a micro-OLED type display, or a liquid crystal display (LCD) illuminated by a backlight. In some embodiments, the electronic display 18 may include a touch screen, which may allow users to interact with a user interface of the electronic device 10. The electronic display 18 may employ display panel sensing to identify operational variations of the electronic display 18. This may allow the processor core complex 12 to adjust image data that is sent to the electronic display 18 to compensate for these variations, thereby improving the quality of the image frames appearing on the electronic display 18.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interface 26. The network interface 26 may include, for example, interfaces for a personal area network (PAN), such as a Bluetooth network, for a local area network (LAN) or wireless local area network (WLAN), such as an 802.11x Wi-Fi network, and/or for a wide area network (WAN), such as a cellular network. The network interface 26 may also include interfaces for, for example, broadband fixed wireless access networks (WiMAX), mobile broadband wireless networks (mobile WiMAX), asynchronous digital subscriber lines (e.g., ADSL, VDSL), digital video broadcasting-terrestrial (DVB-T) and its extension DVB Handheld (DVB-H), ultra wideband (UWB), alternating current (AC) power lines, and so forth. The power source 29 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. of Cupertino, Calif. By way of example, the electronic device 10, taking the form of a notebook computer 10A, is illustrated in FIG. 2 in accordance with one embodiment of the present disclosure. The depicted computer 10A may include a housing or enclosure 36, an electronic display 18, input structures 22, and ports of an I/O interface 24. In one embodiment, the input structures 22 (such as a keyboard and/or touchpad) may be used to interact with the computer 10A, such as to start, control, or operate a GUI or applications running on computer 10A. For example, a keyboard and/or touchpad may allow a user to navigate a user interface or application interface displayed on the electronic display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. The handheld device 10B may include an enclosure 36 to protect interior components from physical damage and to shield them from electromagnetic interference. The enclosure 36 may surround the electronic display 18. The I/O interfaces 24 may open through the enclosure 36 and may include, for example, an I/O port for a hard wired connection for charging and/or content manipulation using a standard connector and protocol, such as the Lightning connector provided by Apple Inc., a universal serial bus (USB), or other similar connector and protocol.

User input structures 22, in combination with the electronic display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone may obtain a user's voice for various voice-related features, and a speaker may enable audio playback and/or certain phone capabilities. The input structures 22 may also include a headphone input may provide a connection to external speakers and/or headphones.

FIG. 4 depicts a front view of another handheld device 10C, which represents another embodiment of the electronic device 10. The handheld device 10C may represent, for example, a tablet computer or portable computing device. By way of example, the handheld device 10C may be a tablet-sized embodiment of the electronic device 10, which may be, for example, a model of an iPad® available from Apple Inc.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the electronic display 18. In certain embodiments, a user of the computer 10D may interact with the computer 10D using various peripheral input devices, such as input structures 22A or 22B (e.g., keyboard and mouse), which may connect to the computer 10D.

Similarly, FIG. 6 depicts a wearable electronic device 10E representing another embodiment of the electronic device 10 of FIG. 1 that may operate using the techniques described herein. By way of example, the wearable electronic device 10E, which may include a wristband 43, may be an Apple Watch® by Apple, Inc. However, in other embodiments, the wearable electronic device 10E may include any wearable electronic device such as, for example, a wearable exercise monitoring device (e.g., pedometer, accelerometer, heart rate monitor), or other device by another manufacturer. The electronic display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
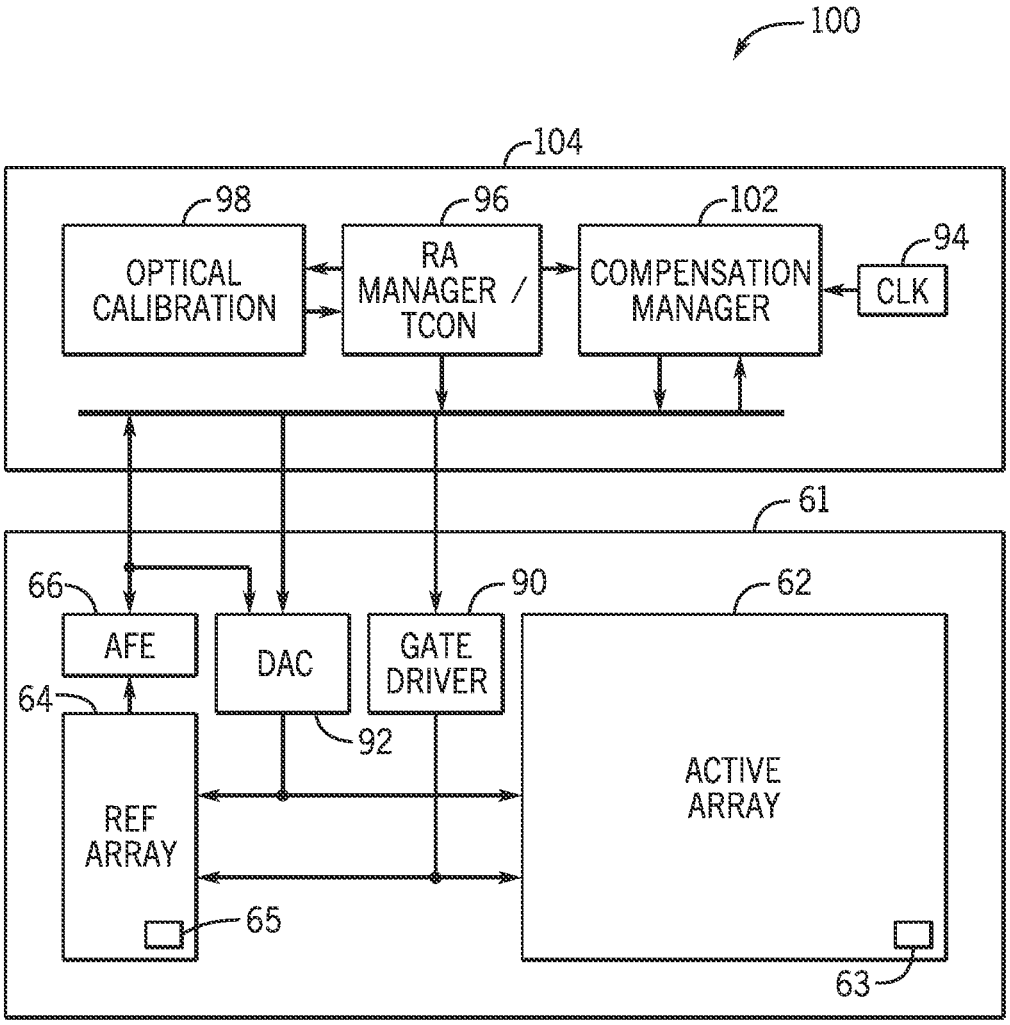
FIG. 7 is a block diagram of an example architecture for closed-loop compensation based on a current-voltage curve, according to an embodiment of the present disclosure.

FIG. 7 is a block diagram of an example architecture 100 for closed-loop compensation based on a current-voltage curve, according to an embodiment of the present disclosure. The architecture 100 includes compensation circuitry 104 coupled to the display panel 61. As illustrated, the display panel 61 includes a number of gate drivers 90 coupled to the active array 62 and the reference array 64. The active array 62 comprises a first number of pixels 63 and the reference array comprises a second number of pixels 65. The reference array 64 may include any suitable number (e.g., 1-1000) of columns of pixels 65. In some embodiments, a number of the pixels 65 in the reference array may be equal to or less than a number of the pixels 63 in the active array 62.

The display panel 61 may also include a sensing analog front end (AFE) 66 to perform analog sensing of the response of the pixels 63, 65 to input data. In some embodiments, the AFE 66 may be used for sensing in both the active array 62 and the reference array 64. In alternative or additional embodiments, there may be at least a first AFE used for sensing in the active array 62 and at least a second AFE used for sensing in the reference array 64.

The display panel 61 may also include a digital-to-analog converter (DAC) 92. The DAC 92 may be a gamma DAC and provide gamma correction to the pixels 63, 65 of the active array and/or reference array based on the IV curve, as discussed below. As illustrated, the DAC 92 is coupled to and shared by the reference array 64 and the active array 62. In additional or alternative embodiments, at least a first DAC may be coupled to the active array 62 and at least a second DAC may be coupled to the reference array 64.

As illustrated, the compensation circuitry 104 includes an optical calibration 98, a reference array manager 96, a compensation manager 102, and a clock 94. The optical calibration 98 may provide a target current value to be applied to a diode of a pixel 63, 65 to emit a target gamma value. In some embodiments, the target current value may be based on a current and/or voltage sensed at the respective pixel 65 in the reference array 64.

The reference array manager 96 include a timing controller (TCON) and may share some functionality of the processor core complex 12 with respect to the reference array 64. For example, the reference array manager 96 may cause the reference array 64 to perform a sensing operation and generate a current-voltage (IV) curve that may be used to adjust image data to be displayed on the electronic display 18 via the active array 62. In some embodiments, the reference array manager 96 may control timing of the sensing operation of the reference array 64. For example, the reference array manager 96 may determine an interval at which the sensing operation is performed on the pixels 65 of the reference array 64.

The compensation manager 102 may receive the IV curve (e.g., IV data) from the reference array manager 96 and determine an amount of compensation to adjust the image data. In some embodiments, the compensation manager 102 may generate an IV spline coefficient for the reference array 64. In some embodiments, the compensation manager may be implemented via hardware elements (including circuitry), software elements (including machine-executable instructions stored on a tangible, non-transitory medium, such as the local memory 14 or the main memory storage device 16 discussed with respect to FIG. 1) or a combination of both hardware and software elements. The compensation manager 102 is discussed in detail below with respect to FIG. 9.

In some embodiments, the compensation manager 102 may send signals across gate lines of the display panel 61 to cause a row of pixels 63 of the active array 62 to become activated and programmable, at which point the compensation manager 102 may transmit the image data (e.g., input data to be displayed by the display panel 61) across data lines (e.g., via the gate drivers 90) to program the pixels 63 to display a particular grey level (e.g., individual pixel brightness). By supplying the image data to different pixels 63 of different colors, full-color images may be programmed into the pixels 63 of the active array 62 of the display panel 61.

The compensation manager 102 may also send signals across gate lines to cause a row of pixels 65 of a reference array 64 to become activated and programmable. For example, the compensation manager 102 may send signals to the pixels 65 of the reference array via the gate drivers 90. The reference array 64 may not be visible to a user of the electronic device 10. For example, the reference array 64 may be covered by an opaque structure or material (e.g., black material) that blocks sight of the reference array 64 from view. In some embodiments, the reference array 64 may wrap around an edge or back side of the electronic device 10 such that it is hidden from view.

In some embodiments, the compensation manager 102 may send sense control signals 68 to cause the display 18 to perform display panel sensing. In response, the display 18 may send sense feedback representing digital information relating to the operational variations of the display 18. The sense feedback may be input to the compensation manager 102 and take any suitable form. An output of the compensation manager 102 may take any suitable form and may be converted into a compensation value that, when applied to the image data, appropriately compensates for operational changes of the display 18 (e.g., resulting in global changes to the display 18). This may result in greater fidelity of the image data, reducing or eliminating visual artifacts that would otherwise occur due to the operational variations of the display 18.

Figure 8:
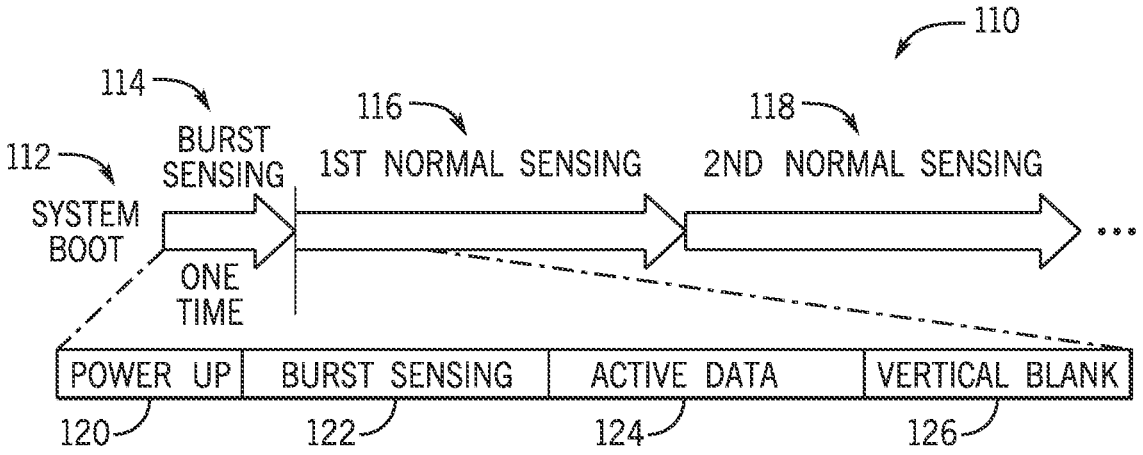
FIG. 8 is a timing diagram for a sensing operation of a reference array, according to some embodiments of the present disclosure.

FIG. 8 is a timing diagram 110 for a sensing operation of a reference array 64, according to some embodiments of the present disclosure. The timing diagram 110 illustrates various types of sensing operations that may occur at startup and during normal operation of the electronic device 10. For example, at startup 112 of the electronic device, a burst sensing operation 114 may occur. Subsequently, a normal sensing operation 116, 118 may be used. That is, the burst sensing operation 114 may occur once when the electronic device is powered on. Subsequent sensing operations may be normal sensing operations 116, 118.

After the electronic device is turned on at operation 120, the burst sensing operation 122 may be initialized to consecutively sense a current and/or voltage at multiple pixels 65 of the reference array 64. In some embodiments, the current-voltage data from the burst sensing operation 122 may be used to generate one or more taps to be used for determining compensation values for the pixels 63 of the active array 62. As an example, between 5 and 20 taps may be used. That is, the burst sensing operation 122 may be used to determine tap points on the IV curve to be compared to the target current value from the optical calibration 98.

After the burst sensing operation 122, data 124 may be sent to the active array 62 to program the pixels 63 thereof. The normal sensing operations 116, 118 may be performed on the pixels 65 of the reference array 64 during a vertical blank 126 of each image frame programmed at the pixels 63 of the active array 62. In some embodiments, the normal sensing operations 116, 118 may be time triggered to occur at a given time interval (e.g., two seconds). In this way, the normal sensing operations 116, 118 may continuously track current and/or temperature drift of the pixels 63, 65.

The timing diagram 110 illustrates how the burst sensing operation 114 occurs at the start-up of the electronic device 10 and is used to determine baseline data for the IV curve. Then, the normal sensing operations 116, 118 are executed to obtain current sensing data that is used to update the IV curve. The various sensing operations 114, 116, 118 are used to obtain sensing data to generate and update the IV curve to improve an accuracy of the IV curve over time and track the operation of the electronic display 18.

Figure 9:
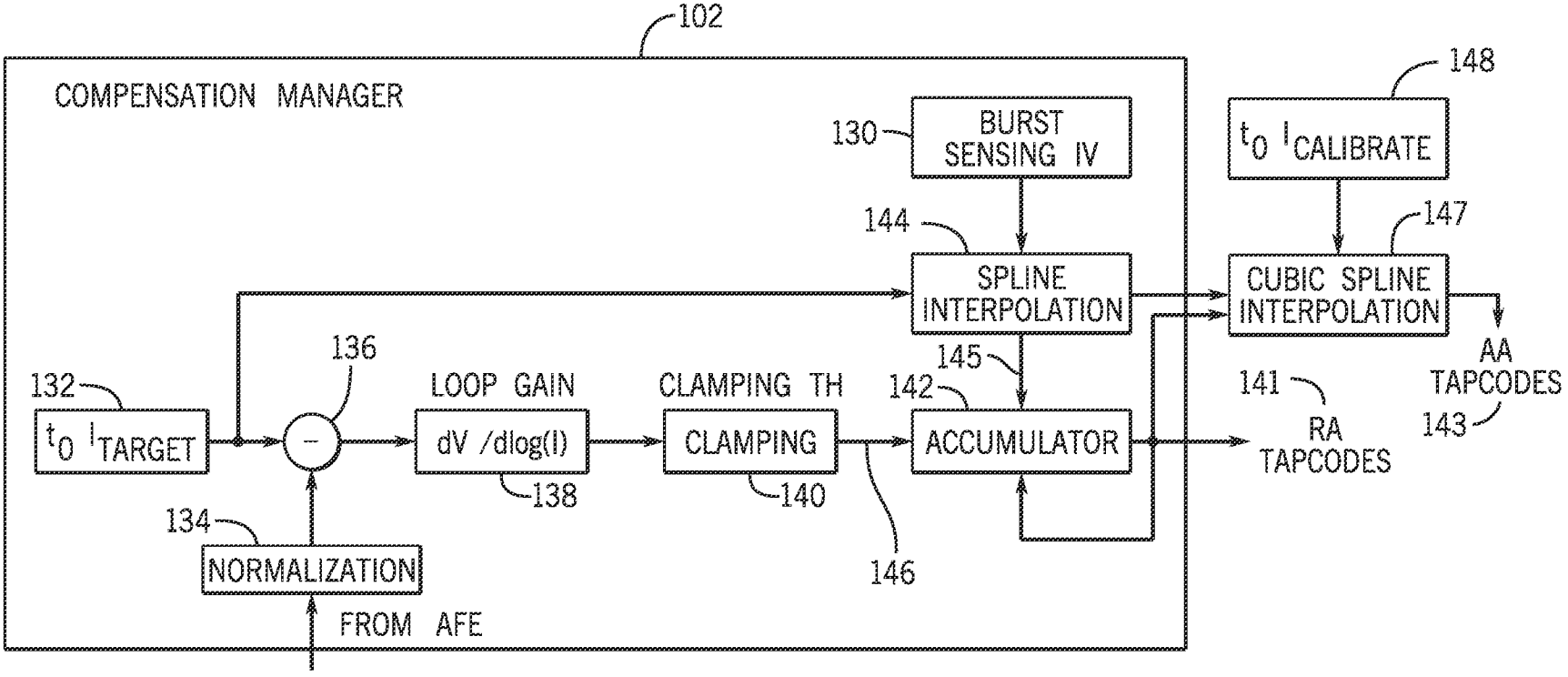
FIG. 9 is a block diagram of an example architecture of the compensation manager of FIG. 7, according to some embodiments of the present disclosure.

FIG. 9 is a block diagram of an example architecture of the compensation manager 102 of FIG. 7, according to some embodiments of the present disclosure. The compensation manager 102 receives the IV sensing data 130 from the burst sensing operation 122 as a baseline. The IV sensing data 130 from the burst sensing operation 122 is used to compute initial gamma tap points 145 for the reference array 64. The initial gamma tap points 145 may be computed based on an initial IV curve generated from the burst sensing data 130. Once the normal sensing operation 116, 118 is performed, the compensation manager 102 receives a digitized current from the AFE 66. A normalizer 134 normalizes the digitized current. A comparator 136 compares and determines a delta between the normalized current and target currents 132. The target current 123 may be provided by the optical calibration unit 98 and may be a current to which the reference array is expected to converge and has a range large enough to cover the entire gamma range of a calibration current 148.

The compensation manager 102 multiplies the delta by a loop gain 138 and clamps 140 the output of the loop gain 138 to reduce any sudden increase in the voltage applied to the corresponding pixel 63 which could cause a sudden change in the luminance change during operation of the display panel 61. The loop gain 138 and the clamping threshold 140 may depend on the slope of the IV curve. Thus, the value of the loop gain 138 and the clamping threshold 140 may be determined to match or closely resemble the slope of the IV curve. This may lead to a smooth settling of the voltage applied to the corresponding pixel 63 in the active array 62. In some embodiments, the clamping 140 may be performed using a clamping threshold which is grey level dependent. That is, for a low grey level of the corresponding pixel, a high clamping threshold 140 may be used. The output of the clamping threshold 140 is one or more tapcode adjustments 146 for the gamma tap points 145. An accumulator 142 adds the tapcode adjustments 146 and the gamma tap points 145. An output of the accumulator 142 is one or more gamma tap points 141 for the reference array 64. In some embodiments, spline interpolation 144 may be applied to the burst sensing data 130 for smoothing of the IV curve. In that case, the output of the spline interpolation 144 includes the initial gamma tap points 145 for the reference array 64.

The compensation manager 102 compensates for variations in temperature and periphery circuit aging and ensures that a proper voltage is applied to pixels 63 in the active array 62 based on the input image data. In this way, the compensation manager may increase a performance of the display 18 by reducing visible anomalies.

To generate gamma tap points 143 for the active array 62, cubic spline interpolation 147 may be applied to a combination of calibrated pixel currents 148, the gamma tap points 141 of the reference array 64, and the target currents 132. The calibrated pixel currents 148 may be current values that when applied to various pixels of the display 18 cause a target luminance of the pixels at selected grey levels. The gamma tap points 143 for the active array 62 are used to drive pixel drivers of pixels 63 in the active array 62. That is, the gamma tap points 143 for the active array 62 and the gamma tap points 141 of the reference array 64 are provided to the DAC 92 of the display panel 61, as discussed with respect to FIG. 7.

Figure 10:
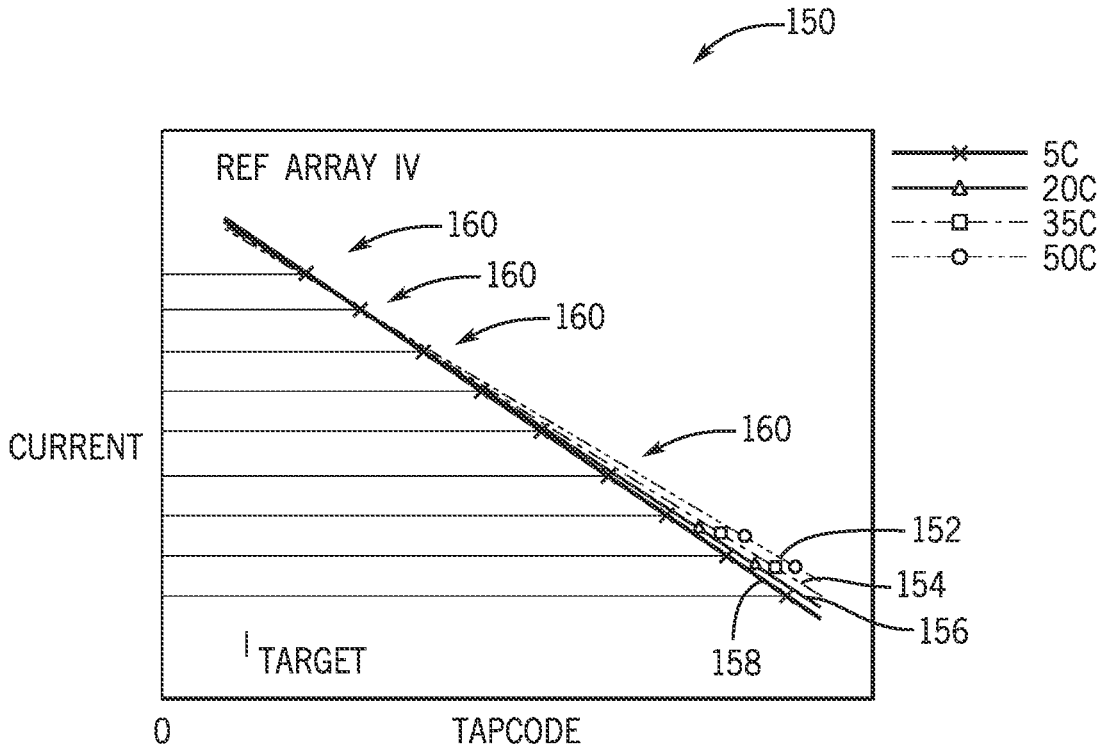
FIG. 10 illustrates a current-voltage curve based on data sensed from the reference array, according to some embodiments of the present disclosure.

FIG. 10 illustrates a current-voltage (IV) curve 150 based on data sensed from the reference array 64, according to some embodiments of the present disclosure. As shown, the IV curve 150 is plotted on a logarithmic scale. In some embodiments, the IV curve 150 may be based on a different scale to make the IV curve 150 more linear. A number of taps 160 (e.g., gamma tap points) are determined based on the current-voltage data from the burst sensing operation 122. A current value corresponding to the taps 160 may be used by the compensation manager 102 to determine compensation values to be applied to the pixels 63 of the active array 62 to compensate for variations in pixel temperature and periphery circuit aging. In some embodiments, the taps 160 may be used to obtain a target brightness level at the pixel 63 of the active array 62.

As shown, the IV curve 150 includes various curves corresponding to different temperatures of the reference array 64 and/or the pixels 65 of the reference array 64. For example, a first IV curve 152 may correspond to a temperature of about 50 degrees Celsius, a second IV curve 154 may correspond to a temperature of about 35 degrees Celsius, a third IV curve 156 may correspond to a temperature of about 20 degrees Celsius, and a fourth IV curve 158 may correspond to a temperature of about 5 degrees Celsius. Thus, the IV curve 150 may be based at least in part on a temperature of the reference array 64 and/or the pixels 65 of the reference array 64.

Figure 11:
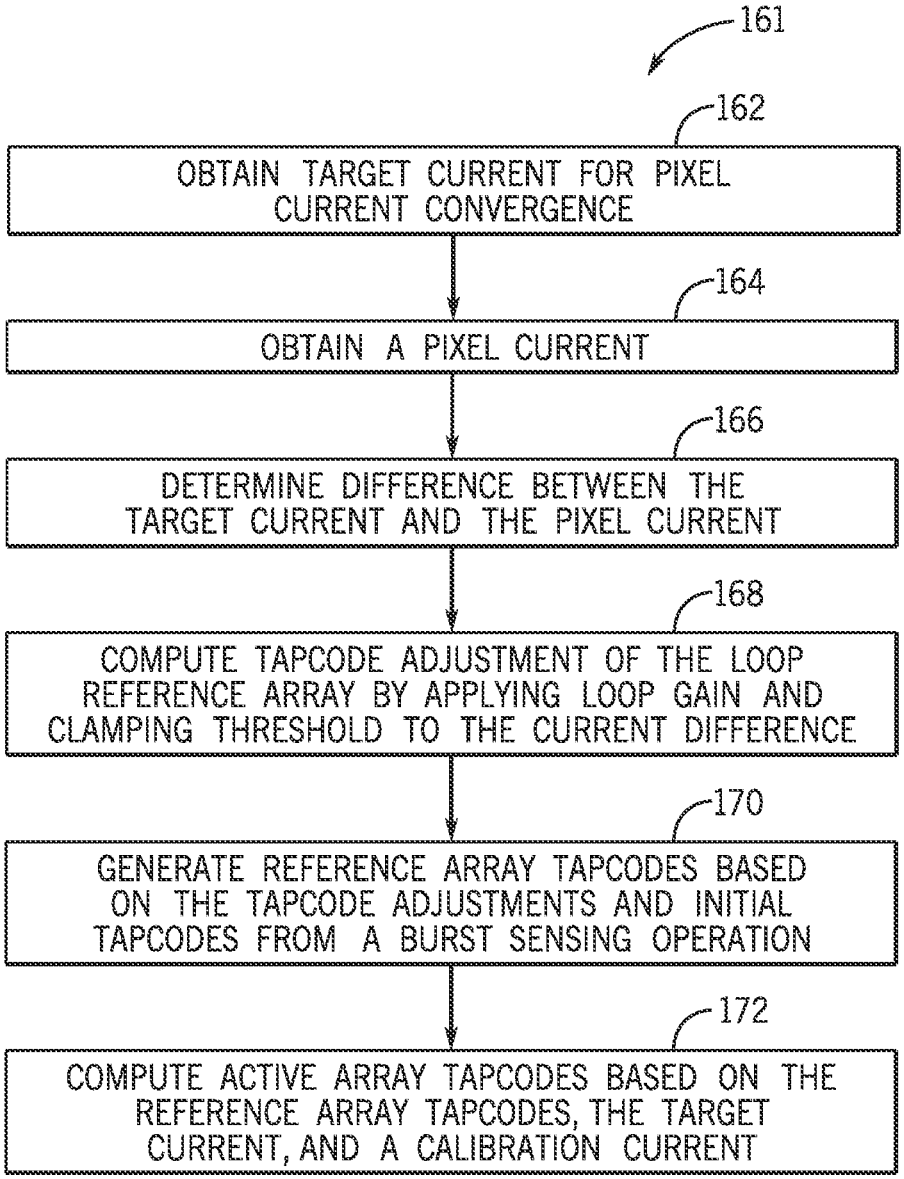
FIG. 11 is a flowchart for sensing and compensation using the architecture of FIG. 7, according to an embodiment of the present disclosure.

FIG. 11 is a flowchart 161 for sensing and compensation using the architecture of FIG. 7, according to an embodiment of the present disclosure. The example operations of the flowchart 161 may be performed by one or more components of the electronic device 10 of FIG. 1, including, for example, the processor core complex 12. Moreover, the flowchart 161 is merely an example of the operations that may be performed, and at least some operations of the flowchart 161 may be performed in a different order or skipped altogether.

The flowchart 161 begins at operation 162 where a target current 132 is obtained by the compensation manager 102. The optical calibration unit 98 may provide the target current 132 to the compensation manager 102. The target current 132 may be based on a target luminance level (e.g., brightness level) for a corresponding pixel at a particular grey level. That is, the target current 132 when applied to pixels of the display 18 satisfies a target luminance of the display panel 61 at a particular grey level. The target current 132 may be a target convergence current of the reference array 64. That is, the target current 132 is a current to which the reference array 64 is expected to converge. At operation 164, a pixel current is sensed and obtained by the compensation manager 102. The pixel current may be received from the analog front end (AFE) 66 of the display 18. The pixel current may be measured at a corresponding pixel 65 of the reference array 64 and converted to a digitized current by the AFE 66.

At operation 166, the compensation manager 102 determines a difference between the target current 132 and the pixel current. At operation 168, the compensation manager 102 computes tapcode adjustments 146 (e.g., adjustments to the gamma tap points 141, 143) by applying a loop gain 138 and a clamping threshold 140 to the difference 136 determined at operation 166. The loop gain 138 and the clamping threshold 140 may be computed to satisfy a slope of a current-voltage curve generated from burst sensing data 130, as discussed above with respect to FIGS. 8 and 9.

At operation 170, the compensation manager 102 generates reference array tapcodes (e.g., gamma tap points) based on the tapcode adjustments and initial tapcodes generated from the burst sensing operation. To do so, the compensation manager 102 may aggregate (e.g., combine) the tapcode adjustments 146 and the initial tapcodes 145 to adjust the initial tapcodes 145 based on the tapcode adjustments 146. As discussed with respect to FIGS. 8-10, the burst sensing data 130 may provide baseline data to generate the current-voltage curve. The reference array tapcodes 141 determined at operation 170 may be used to drive one or more pixels 65 in the reference array 64.

At operation 172, the compensation manager 102 computes active array tapcodes 143 (e.g., gamma tap points 143 of the active array 62) based on the reference array tap codes 141 determined at operation 170, the target current 132, and a calibration current 148. The calibration current 148 may be a current that when applied to various pixels of the display 18 causes a target luminance of the pixels at selected grey levels. The active array tapcodes 143 may be used to drive pixels 63 of the pixels 63 of the active array 62 via one or more drivers (e.g., source drivers and/or gate drivers) of the display 18. That is, the active array tapcodes 143 may be provided to the DAC 92 of the display panel 61 to drive the pixels 63 of the active array 62. During operation of the display 18, the compensation manager 102 may periodically obtain a new target current 132 and pixel current, and update the current-voltage curve and tapcodes 143 used to drive the pixels 63 of the active array 62 using the operations of the flowchart 161. That is, the operations of the flowchart 161 may be used to update and track the current-voltage curve over time and compensate for variations in temperature and periphery circuit aging, among other things.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An electronic device comprising:

a reference array comprising a first plurality of pixels of a display panel;

reference array sensing circuitry configured to acquire a first plurality of currents by consecutively sensing a current in each pixel of the first plurality of pixels during a burst sensing operation;

an active array of the display panel comprising a second plurality of pixels; and a compensation manager configured to:

generate an initial current-voltage curve based on the first plurality of currents and a target current;

determine one or more gamma tap points based on the initial current-voltage curve;

receive a second plurality of currents associated with a first pixel of the first plurality of pixels during a plurality of vertical blanking periods of a plurality of frames of image data, wherein the plurality of frames of image data is received after the burst sensing operation;

generate an updated current-voltage curve based on the initial current-voltage curve and each current of the second plurality of currents sensed in the first pixel;

determine one or more updated gamma tap points based on the updated current-voltage curve.

2. The electronic device of claim 1, the electronic device comprising:

active array sensing circuitry configured to acquire a third plurality of currents associated with a second pixel of the second plurality of pixels.

3. The electronic device of claim 2, wherein the compensation manager is configured to program the second pixel based on the updated current-voltage curve and the third plurality of currents.

4. The electronic device of claim 2, wherein the compensation manager comprises a negative feedback loop configured to continuously update the initial current-voltage curve and an additional current used to program the second pixel.

5. The electronic device of claim 1, wherein the burst sensing operation is performed upon start-up of the electronic device.

6. The electronic device of claim 1, wherein the burst sensing operation comprises obtaining the first current at a number of consecutive gamma tap points.

7. The electronic device of claim 1, wherein the compensation manager is configured to apply a loop gain and a clamping threshold to the first current and the second current before generating or updating the initial current-voltage curve.

8. An electronic device comprising:

a reference array comprising a first plurality of pixels;

reference array sensing circuitry configured to acquire a first plurality of currents by consecutively sensing a current in each pixel of the first plurality of currents during a burst sensing operation;

an active array comprising a second plurality of pixels; and a gate driver coupled to the second plurality of pixels; and a compensation manager configured to:

perform the burst sensing operation to obtain baseline current data based on the first plurality of currents;

perform subsequent sensing operations to receive a second plurality of currents associated with a first pixel of the first plurality of pixels during a plurality of vertical blanking periods of a plurality of frames of image data, wherein the plurality of frames of image data is received after the burst sensing operation;

generate a current-voltage curve based on the baseline current data and the second plurality of currents;

determine a set of gamma tap points for each brightness setting of an electronic display based at least in part on the current-voltage curve; and instruct the gate driver to program the second plurality of pixels based on image data and the set of gamma tap points.

9. The electronic device of claim 8, wherein the compensation manager is configured to:

generate an initial current-voltage curve based on the first plurality of currents;

determine an initial set of gamma tap points based at least in part on the initial current-voltage curve; and instruct the gate driver to program the second plurality of pixels based on the initial set of gamma tap points.

10. The electronic device of claim 9, wherein the compensation manager performs the subsequent sensing operations at a periodic time interval.

11. The electronic device of claim 8, wherein the burst sensing operation is performed upon start-up of the electronic device and wherein the burst sensing operation comprises obtaining the current at a number of consecutive gamma tap points based at least in part on the current-voltage curve.

12. The electronic device of claim 11, wherein the gate driver drives illumination of the second plurality of pixels based at least in part on the set of gamma tap points.

13. The electronic device of claim 8, wherein the compensation manager comprises a negative feedback loop to continuously update the current-voltage curve and a current used to program the second plurality of pixels.

14. The electronic device of claim 8, wherein the active array does not include light emitting diodes (LEDs) during a testing procedure.

15. A method comprising:

obtaining current-voltage data associated with a plurality of currents in an electronic display by consecutively sensing a current in each pixel of a plurality of pixels in the electronic display during a burst sensing operation;

obtaining a target current for a pixel in a reference array of the electronic display;

sensing a pixel current through the pixel after performing the burst sensing operation;

determining a delta between the target current and the pixel current;

generating an adjusted delta by applying a loop gain and a clamping threshold to the delta;

combining the adjusted delta and the current-voltage data as compensated current-voltage data; and driving one or more pixels of an active array of the electronic display based at least in part on the compensated current-voltage data.

16. The method of claim 15, comprising:

generating a current-voltage curve based at least in part on the target current and the pixel current;

periodically sensing a new pixel current through the pixel; and updating the current-voltage curve based at least in part on the new pixel current.

17. The method of claim 16, wherein the burst sensing operation is performed on start-up of the electronic display and comprises obtaining current-voltage data at a number of consecutive gamma tap points based at least in part on the current-voltage curve.

18. The method of claim 16, comprising:

determining a set of gamma tap points for each brightness setting of the electronic display based at least in part on the current-voltage curve.

19. The method of claim 18, wherein the set of gamma tap points is used to obtain a target brightness level at the one or more pixels of the active array.

20. The method of claim 18, comprising:

driving the one or more pixels of the active array based at least in part on the set of gamma tap points.

* * * * *